United States Patent [19]

Tappel

[11] Patent Number: 4,846,203

[45] Date of Patent: Jul. 11, 1989

[54] STOWABLE CRUTCH

[75] Inventor: James G. Tappel, Palo Alto, Calif.

[73] Assignee: Luconex, Inc., Foster City, Calif.

[21] Appl. No.: 56,849

[22] Filed: Jun. 2, 1987

Related U.S. Application Data

[63] Continuation-in-part of Ser. No. 747,082, Jun. 19, 1985.

[51] Int. Cl.[4] ..... A61H 3/02

[52] U.S. Cl. ..... 135/69

[58] Field of Search ..... 135/17, 18, 19, 65, 135/66, 68, 69, 71, 72, 73, 75, 76; 403/359

[56] References Cited

U.S. PATENT DOCUMENTS

| | | | |
|---|---|---|---|
| 869,128 | 10/1907 | Autenrieth | 135/66 |
| 1,197,375 | 9/1916 | Hoff | 135/69 |
| 2,528,706 | 11/1950 | Osborn | 135/69 |
| 2,817,348 | 12/1957 | Holliday, Jr. | 135/72 |
| 3,208,461 | 9/1965 | Irwin | 135/69 |
| 3,254,659 | 6/1966 | Williams | 135/69 |
| 3,947,140 | 3/1976 | Thomas | 135/69 |

*Primary Examiner*—Robert A. Hafer
*Assistant Examiner*—Charles H. Sam
*Attorney, Agent, or Firm*—Townsend & Townsend

[57] ABSTRACT

A stowable crutch is disclosed which includes two parallel integrated tubes in a single body with a first tube to which a crutch tip is mounted and a second tube to which a rest support is attached, each slidably mounted within an integrated tube. The interior of the integrated tubes are fluted or polygonal in cross section to engage a ratchet or detent mounted on the end of the first and second tubes to effectuate a selection means. The first and second tubes are engaged by an external detent mounted at either end of the body. The first and second tubes are rotated individually to a desired selection and extended to that length whereupon they engage with the external detent. The handgrip is slidably mounted to the body to provide a wide range of adjustment. The external detents provide a means to signal when the first and second tubes are not securely engaged.

6 Claims, 2 Drawing Sheets

STOWABLE CRUTCH

BACKGROUND OF THE INVENTION

1. Field of the Invention

This invention relates to aids for a temporarily or permanently disabled individual, and in particular to a crutch which at the option of the user may be stowed in a much more compact form than when in use. The invention relates to a stowable crutch whose size may be selected and simply and safely extended without additional tools. The invention also relates to a single crutch which may be fitted to the vast majority of users.

2. Description of the Prior Art

The crutches of the prior art include the common wooden or aluminum variety. Generally, such crutches have two members supporting an underarm rest support and pad with a handle disposed between the two members for the user's grip. The two members come together beneath the grip, and from there a single member extends to the ground. Such crutches have several disadvantages. To extend from beneath the user's arm to the ground, such crutches must be on the order of four to five feet in length, and a variety of sizes must generally be available to accommodate all users. Thus, whenever the user of such a crutch is sitting or reclining, the crutch must be leaned against a wall or chair, or otherwise stored. Because of the bulkiness, storage of such crutches is difficult, particularly in confined situations such as while riding in a wheelchair, sitting in an airplane seat, or sitting in a restaurant. Furthermore, such crutches, by virtue of their structure, may be adjusted only with tools such as wrenches or screwdrivers. To make such adjustments, the user must remove two or more bolts in each crutch which secure the single member to the pair of members, re-adjust the length, and re-tighten the bolts. A variety of sizes is required to fit all users of this type of crutch. Furthermore, the orientation of the handgrip and the rest support is always fixed.

One crutch which attempts to overcome the above disadvantages is manufactured by Husa Company. The Husa type crutch includes a folding joint at the intersection between the single member and the pair of members to enable the crutch to be folded in half. Although this provides some improvement in stowability, the resulting crutch is still not sufficiently small to fit comfortably in a wheelchair, or to be placed beneath the seat in a commercial airliner.

Another crutch known to me, but not necessarily in the prior art, is the Stanford crutch. This crutch is larger, less adjustable and more difficult to use. The Stanford crutch consists of a double tube or "barrel" body from which two telescoping tubes extend up and down to a rest support and a crutch tip. The crutch tip and rest support on the Stanford crutch are secured by a spring-loaded detent inside the telescoping members that engage between the body of the crutch and the telescoping member. This creates a problem in that the detent has to be first disengaged from the compact position and then engaged in each hole position until the crutch tip or rest support was extended to the proper length for the user. This method of securing the telescoping member to the body of the crutch also has the shortcoming of having the detent "lost." Since the detent is inside of the telescoping member and engages outwardly into a position hole in the body of the crutch, the detent does not engage and becomes "lost" within the barrel of the body if the telescoping member is turned even slightly while being extended. Furthermore, unless the detent is perfectly aligned with the position hole, the detent will not fully engage and the telescoping member is not secure. This makes the Stanford crutch difficult to extend quickly and required a "second look" to insure that the detent was fully engaged. The Stanford crutch also requires tools, such as a hex key wrench, to adjust the rest support orientation with respect to the handgrip. The handgrip position was also unadjustable with respect to the body of the crutch. The Stanford crutch incorporates a large number of parts and substantial assembly time.

SUMMARY OF THE INVENTION

This invention provides a crutch whose size may be easily and quickly reduced for storage within a wheelchair or beneath an airline seat. The preferred embodiment of the invention allows for a selection means to first select a desired length and then extend the crutch tip or rest support quickly to the selected position. A "flag" warns if the crutch is not securely engaged and ready for use and to an adjustable handgrip to accommodate a variety of users with different heights and arm lengths.

DETAILED DESCRIPTION OF THE PREFERRED EMBODIMENTS

Figure 1A:
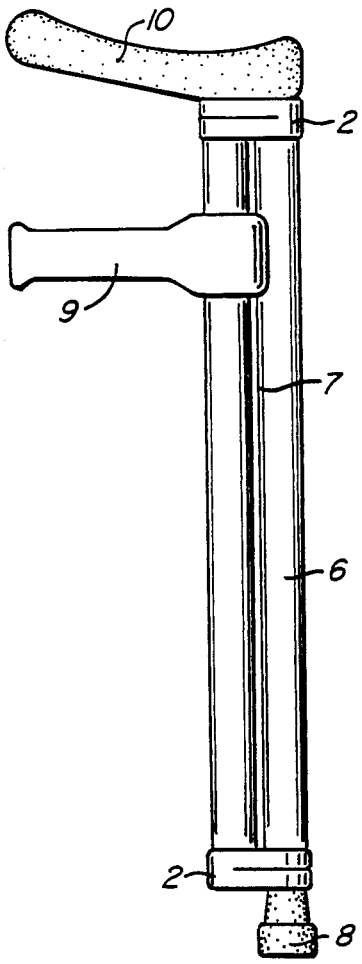
FIG. 1A is a perspective view of a preferred embodiment of the stowable crutch illustrating its unextended position.
Figure 2B:
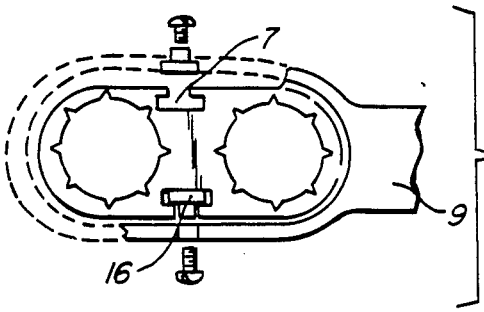
FIG. 2B is a diagram showing the preferred embodiment of the adjustable handgrip.
Figure 2A:
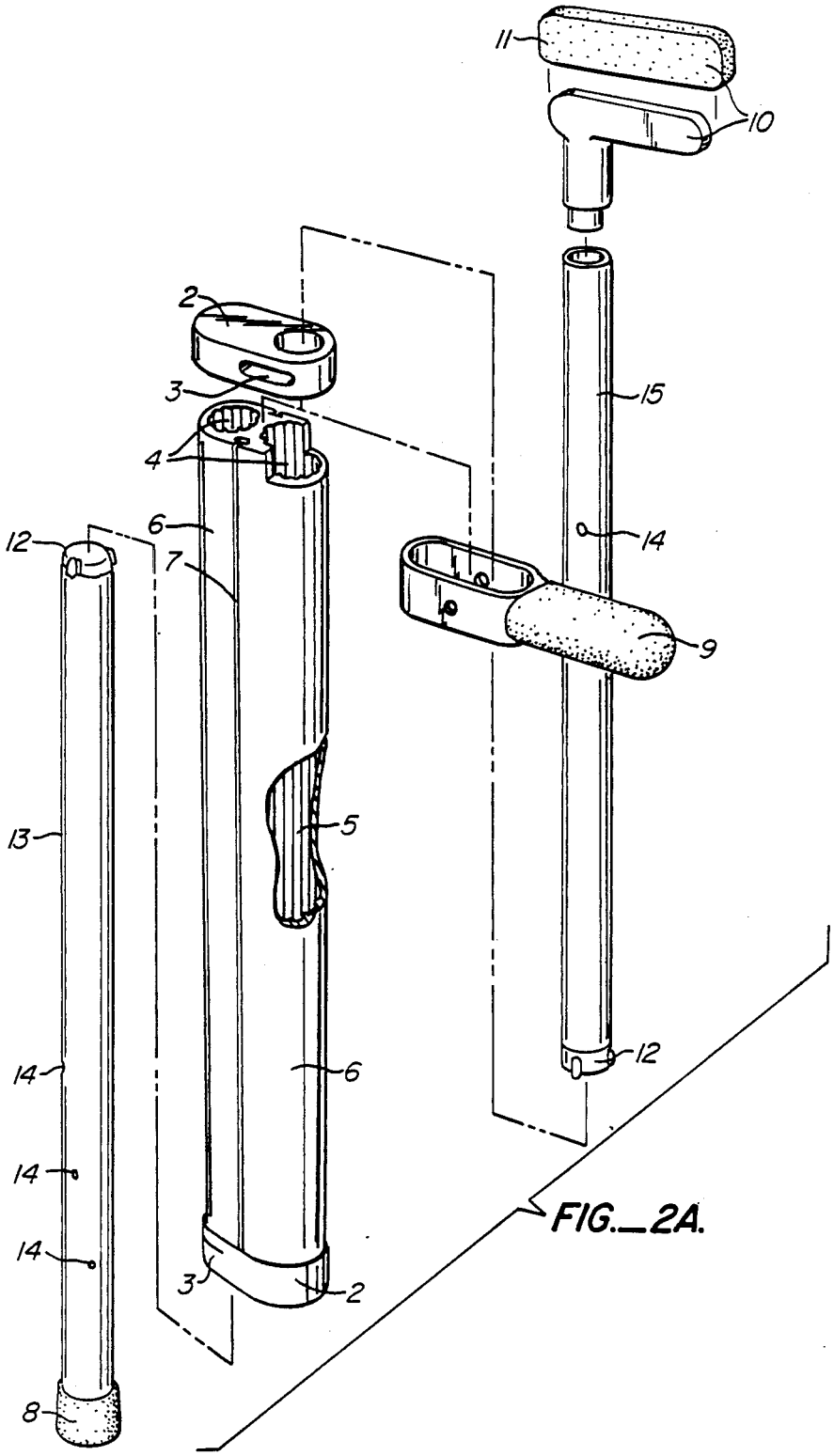
FIG. 2A is an exploded view of a preferred embodiment of the stowable crutch illustrating the manner of construction and showing all parts.

FIG. 1A is a perspective view of a preferred embodiment of the stowable crutch using an underarm rest support 10, and depicts the stowable crutch in the form in which it will fit under an airline seat or within a wheelchair. FIG. 2A is an exploded view of a preferred embodiment of the stowable crutch. As shown in FIG. 2A, the crutch includes a body 6, a crutch tip 8, an underarm rest support 10 with rubber pad 11, a handgrip 9, external detents 3, end caps 2, and internal detents or ratchets 12. A first telescoping means connected to the crutch tip for extending the crutch tip downward from the body consists of a tube 13 slidable within the body, while a second telescoping means connected to the underarm support consists of a tube 15 slidable within the body for extending the rest support upward from the body.

Figure 1B:
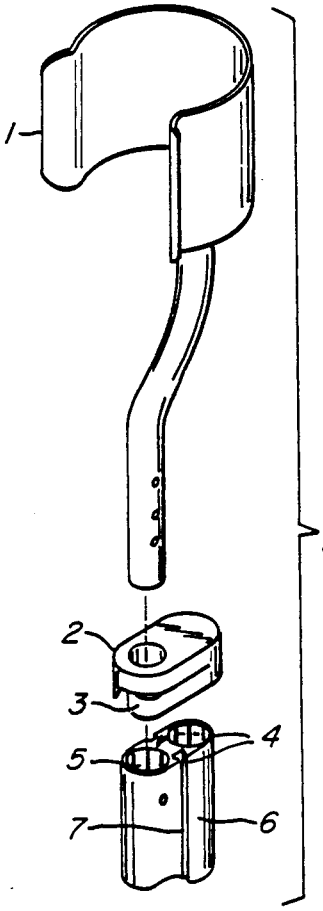
FIG. 1B is an exploded view of a preferred embodiment of the stowable crutch illustrating the external detent and top of the body showing octagonal internal shaping in conjunction with a forearm support rest.

The body 6 preferably is a single extruded aluminum member, as shown in FIG. 1B, consisting internally of two parallel tubes 4 with splined inner faces 5, and externally of two tracks 7 aligned between the internal splined tubes 4 and on opposite sides of the body 6 from each other. The preferred embodiment of the internal splined tubes 4 includes internally fluted or polygonally shaped tubes to effectuate the selection means.

The first and second telescoping means each consist of a tube adapted to slide within a splined tube 4 within the body. An internal spring-loaded detent or ratchet 12 mounted inside or on the end of the telescoping tubes 13, 15 engages the splines of the internal splined faces 5 within the body 6. In the preferred embodiment, eight position holes 14 placed along a spiral line on the telescoping tubes 13, 15 each correspond to a spline of the internal splined faces 5 within the body 6. External detents 3 mounted on both ends of the body 6 engage the position holes 14 in the telescoping tubes 13. 15. By this preferred embodiment, the telescoping tubes 13, 15, when in the unextended compact position, may be first rotated to a desired position length, as indicated by a marking on end cap 2 and a scale on tubes 13, 15, and then extended until the telescoping tube 13, 15 engages with the external detent 3 mounted at the end to the body 2. In this manner, the external detent 3 engages only the proper extended position hole 14 and is never "lost" as with other crutches.

Further, in the preferred embodiment the external detent is in an "up" position until engaged. The invention also relates to a crutch that will remain in the unextended, compact position without engagement of the external detent 3. This is accomplished by the external detent maintaining sufficient pressure on the telescoping tubes 13, 15 to prevent inadvertent extension. Preferably, a portion of the external detent 3 assembly is painted red such that the red portion is visible when the external detent is not engaged to thereby operate as a warning "flag" when the telescoping tube 13, 15 is extended and not secure.

Finally, the preferred method of mounting the handgrip 9 to the body 6 is by means of a plurality of glides 16 engaged in the two external tracks 7 on the body 6. This allows the handgrip 9 to be adjustable with respect to the body to accommodate variations in arm length of the user.

The preferred embodiment also incorporates several improvements in assembly over the prior art. The invention integrates the body 6 end cap 2 with the external detents 3 and integrates the two internal octagonal tubes 4 together within the body 6 and with the external tracks 7 as a single assembly.

The invention allows the handgrip, rest support and crutch tip to be adjustable with respect to each other thereby allowing the crutch to fit the vast majority of users without necessitating several different sizes.

The invention further relates to a crutch with interchangeable rest suppots. The rest support may be a forearm support 1, an underarm rest support 10 with rubber pad 11 or other arm or underarm brace. The preferred embodiment of the stowable crutch may also be used as a cane with the telescoping tube 15 unextended or removed.

I claim:

1. A crutch comprising:

a body having a pair of parallel tubular openings therein, each of said tubular openings having an axially splined inner face;

a crutch tube slidably received in a first of said tubular openings, said crutch tube having at least one ratchet member exteriorly mounted thereon wherein said ratchet member is capable of engaging the splined face of the tubular opening to maintain rotational alignment of the crutch tube relative to the body, said crutch tube further having a plurality of spirally-displaced detent holes thereon;

first detent means at the opening of the first tubular opening, whereby a rotationally-selected detent hole on the crutch tube will be engaged by the detent means to fix the axial position of the crutch tube relative to the body;

an arm rest support tube slidably received in a second of said tubular openings and oriented to extend in a direction opposite to that of the crutch tube, said arm support tube having at least one ratchet member exteriorly mounted thereon wherein said ratched member is capable of engaging the splined face of the second tubular opening to maintain rotational alignment of the arm rest tube relative, said arm rest support tube further having a plurality of spirally-displaced detent holes thereon; and second detent means at the opening of the second tubular opening, whereby a rotationally-selected detent hole on the arm rest tube will be engaged by the detent means to fix the axial position of the arm rest support tube relative to the body.

2. A structure as in claim 1 further comprising a handgrip slidably mounted to the body; and means for securing the handgrip to the body.

3. A structure as in claim 2, wherein the handgrip is slidably mounted on the body and secured to the body by at least one glide which travels in an axially-aligned track on the body.

4. A structure as in claim 1 wherein the detent means is further comprised of flag means to indicate positive engagement of the detent means.

5. A structure as in claim 1 wherein the said arm rest support tube includes a forearm support at its distal end.

6. A structure as in claim 1 wherein said arm rest support tube includes an underarm rest support member at its distal end.

* * * * *